United States Patent [19]

Bedi et al.

[11] Patent Number: 5,074,380

[45] **Date of Patent: * Dec. 24, 1991**

[54] METHOD AND APPARATUS FOR CHANGING OIL IN AN INTERNAL COMBUSTION ENGINE

[75] Inventors: Ram D. Bedi; Adrianus J. van der Griendt, both of Birmingham, Mich.

[73] Assignee: K. J. Manufacturing Co., Wixom, Mich.

[ * ] Notice: The portion of the term of this patent subsequent to Dec. 11, 2007 has been disclaimed.

[21] Appl. No.: 490,083

[22] Filed: Mar. 7, 1990

[51] Int. Cl.[5] ..... F16N 33/00

[52] U.S. Cl. ..... 184/1.5; 184/105.1; 184/105.3; 123/196 R; 220/235

[58] Field of Search ..... 184/1.5, 105.1, 105.3; 123/196 R, 196 S; 220/212, 234, 235, 356, 304; 215/352, 360; 137/875, 625.2; 285/322, 323, 162, 196, 338, 360, 361, 362

[56] References Cited

U.S. PATENT DOCUMENTS

| | | | |
|---|---|---|---|
| 1,955,169 | 4/1934 | Bertschinger | 184/1.5 |
| 2,249,303 | 7/1941 | Smith | 184/1.5 |
| 2,552,749 | 5/1951 | Tabet | 184/1.5 |
| 2,554,389 | 5/1951 | Stevens | 184/1.5 |
| 2,594,779 | 4/1952 | Huffman | 184/1.5 |
| 2,683,499 | 7/1954 | De Croes | 285/338 |
| 3,272,535 | 9/1966 | Neely | 184/1.5 |
| 4,095,673 | 6/1978 | Takeuchi | 184/1.5 |
| 4,151,823 | 5/1979 | Grosse et al. | 123/196 A |
| 4,193,487 | 3/1980 | Takeuchi | 184/1.5 |
| 4,331,185 | 5/1982 | Rinaldo et al. | 184/105.1 |
| 4,491,103 | 1/1985 | Deadman | 184/105.1 |
| 4,739,861 | 4/1988 | Desjardins | 184/1.5 |
| 4,884,660 | 12/1989 | Bedi | 184/1.5 |
| 4,976,233 | 12/1990 | Bedi et al. | 123/196 R |

FOREIGN PATENT DOCUMENTS

| | | | |
|---|---|---|---|
| 0974011 | 9/1975 | Canada | 285/338 |
| 2035759 | 1/1972 | Fed. Rep. of Germany | 123/196 R |
| 2231100 | 1/1974 | Fed. Rep. of Germany | 184/1.5 |
| 2744776 | 4/1979 | Fed. Rep. of Germany | 184/1.5 |
| 2452592 | 11/1980 | France | 285/322 |

OTHER PUBLICATIONS

Valvoline's Progressive Oil Sample Testing Program; publication date unknown but at least as early as 5-8-89.

Auto-Matic Oil Changer advertisement, Carol Wright Gifts ©1990.

Fluid Evacuators Promotional Literature, publication date unknown.

National Petroleum News-Sep. 1989 (Reprinted from 5-88), Why Quick Lube Outlets are Grabbing Market Share by M. Emond.

National Oil & Lube News-Nov. 1989, NY Fast Lube is Industry Innovator.

National Oil & Lube News-Nov. 1989, European Evacuation Method Enters U.S.A. by S. Bernhard.

*Primary Examiner*—Ira S. Lazarus

*Assistant Examiner*—Alan B. Cariaso

*Attorney, Agent, or Firm*—Basile and Hanlon

[57] ABSTRACT

An apparatus and method for removal of spent oil from an oil pan reservoir of an internal combustion engine includes a flexible tube engageable through the dipstick sleeve of the engine. In the preferred embodiment, a vacuum pump is used to draw vacuum within a receptacle to thereby draw spent oil from the oil pan reservoir of the engine through the tube for temporary storage and transportation in an environmentally safe manner. Valve cover opening fluid fill adaptors are provided for optionally introducing fluid, such as fresh motor oil, through the valve cover opening. A dipstick sleeve adaptor is also disclosed for introducing fluid, such as fresh motor oil, through the dipstick sleeve.

2 Claims, 4 Drawing Sheets

METHOD AND APPARATUS FOR CHANGING OIL IN AN INTERNAL COMBUSTION ENGINE

FIELD OF THE INVENTION

The invention relates to a method and apparatus for changing motor oil in a vehicle having an oil pan or similar oil reservoir. Such reservoirs can be found in automobiles, trucks, tractors, heavy earth moving equipment, military equipment, or the like. More particularly, this invention relates to methods in which spent or dirty oil is expendiently removed from the oil pan which is then refilled with fresh motor oil.

BACKGROUND OF THE INVENTION

The benefits of routine oil changes in a vehicle are well known. Routine oil changes have been shown to increase engine life and performance. With repeated prolonged use, motor oil builds up suspended particles, metallic and non-metallic, from the abrasive and adhesive wear of engine parts against one another and from products of incomplete combustion and improper air intake. The particles in turn cause abrasive wear of the engine bearings, piston rings and other moving parts and the reduction of the motor oil lubricity as various additives and lubricating components become depleted. This adversely affects engine perfomance and if left unchanged can destroy or cripple the engine performance. It is recommended by at least one oil manufacturer that the level of total solid concentration be limited to levels below 3.0% with levels of silica being present in amounts lower than 25 parts per million and sodium in amounts lower than 200 parts per million.

To obtain satisfactory automotive engine performance, and maintain solids concentration levels in the motor oil lower than the recommended 3.0%, changing the motor oil in an automotive engine is a necessary, but an undesirable, dirty and time-consuming task. In currently designed vehicles, the oil pan serves the purpose of a reservoir for circulation of engine oil. Engine lubrication is generally accomplished through a gear-type pump. The pump picks up engine oil from the oil pan sump, where oil is drawn up through the pick-up screen and tube, and passed through the pump to the oil filter. The oil filter is generally a full flow paper element unit. In some vehicles, an oil filter bypass is used to insure adequate oil supply, should the filter become plugged or develop excessive pressure drop. Oil is routed from the filter to the main oil gallery. The gallery supplies valve train components with oil, and by means of intersecting passages, supplies oil to the cam shaft bearings. Oil draining back from the rocker arms is directed, by cast dams in the crank case casting, to supply the cam shaft lobes. Oil also drains past specific hydraulic lifter flats to oil cam shaft lobes directly. The passages supplying oil to the cam shaft bearings also supply the crank shaft main bearings through intersecting passages. Oil from the crank shaft main bearings is supplied to the connecting rod bearings by means of intersecting passages in the crank shaft. The front cam bearing can include a slot on its outside diameter to supply oil to the cam sprocket thrust face. In some engines, many internal engine parts have no direct oil feed and are supplied either by gravity or splash from other direct feed components. A bypass valve can also be disposed in the oil pick-up screen to insure adequate oil flow if the screen should become restricted. A pressure regulator valve, sometimes located in the oil pump body, maintains adequate pressure for the lubrication system and bypasses any excess back to the suction side of the pump. Oil from the pump passes through the filter before going to the engine oil galleries. In the filter, the oil passes through a filtering element where dirt and foreign particles are removed.

To remove the contaminated oil, the drain plug, generally located in the lowermost region of the oil pan, is opened. The spent oil containing suspended particles is permitted to flow under gravity out of the pan into a suitable receptacle. After the spent oil is removed, the plug is replaced and fresh oil is added to the engine usually through a separate opening in the engine valve cover. The process of gravity drainage does not remove all of the spent oil with its metallic and non metallic particlates which stick to the oil pan container walls, as well as engine components such as the crank shaft, connecting rods, pistons and the like which are exposed to the motor oil spray lubrication. These particles remain to be mixed with fresh motor oil. Thus the concentration of contaminants is lowered by dilution and only a part of the total contaminates are actually eliminated.

The oil change process is essentially the same whether performed at home, at service stations or at one of the various oil change centers which have opened in recent years. The flow rate, or time required for oil drainage, is the same for each of these locations, because it is limited by the size of the drain plug aperture and the force of gravity. Service stations and other locations simplify the process of oil drainage with the use of hydraulic racks, special oil collection receptacles and the like. However, this specialized and expensive equipment is not readily available to the typical automotive owner who may wish to change the oil in his vehicle at home. It has been estimated that the retail market of oil is approximately 2.83 billion quarts or approximately 700 million gallons. The do-it-yourself individual has been found to be price sensitive, and tends to distrust the quality of service stations and other oil change centers. The do-it-yourself individual typically believes that if you want a job done right, you do it yourself. However, the current design of vehicles does not lend itself to do-it-yourself oil changes in a convenient clean and effortless manner. Many vehicles have low ground clearance making it difficult to access the oil drain plug for removal of the spent oil, and also making it difficult to collect the oil without contaminating the surrounding environment.

Environmental protection is a prominent social issue in our present society. Therefore, it would be desirable to encourage do-it-yourself oil changers to perform this type of task in an environmentally safe manner. It is estimated that there are approximately 119 million privately owned passenger vehicles. These vehicles require approximately 360 million oil changes a year, using an average of 1.2 gallons per change based on an average oil change frequency of 2.94 times a year. This amounts to approximately 550 million gallons of motor oil a year. Of this amount, it is estimated that 70% of motor oil is installed by motorists themselves. It is believed that pursuant to present practice, the spent oil drained by motorists finds its way into spent household containers, such as milk cartons. The household containers are closed and disposed of in the garbage which can and will finally find its way into the local waste dump. As the household container deteriorates, the oil and its contaminates will eventually seep into the surrounding ground water below the dump site. It has been estimated that 6.6 million barrels of oil a year seeps into U.S. soil creating serious potential ground water pollution problems. It would be desirable environmentally and economically if this oil could be collected and recycled. In order to motivate the do-it-yourself market, it is desirable in the present invention to make the collection of oil during oil changes effortless, clean and inexpensive.

Conservation of energy and the trade deficit are also major issues in today's society. It is estimated that 250–360 million gallons of spent oil can now be easily collected and profitably recycled. The price of spent oil so collected is four dollars per barrel at best, while the price of crude oil is much greater at approximately $18.00 per barrel. Recycling easily collected spent oil could decrease the trade deficit by approximately 120 million dollars, while providing a profitable recycling economy of approximately 86 million dollars per year.

Therefore, it would be desirable to provide a method which accelerates removal of spent oil conveniently, more completely and easily from the crank case. It would also be desirable to provide a system which reduces the amount of spent oil handling as required in the conventional oil change service station. Finally, it is desirable to provide a method which could be easily employed by all the vehicle owners whether at home or at a convenient service station with all the benefits of the method of the present invention such as time savings, money savings, convenience, minimum exposure to motor oil, environmental protection, energy conservation, trade deficit reduction, and finally longer lasting, better performing engines.

SUMMARY OF THE INVENTION

The present invention of a method for removing spent oil from internal combustion engines includes the steps of removing the dipstick from the dipstick aperture of the engine, inserting a specially engineered tube through the dipstick aperture until it reaches the bottom of the oil pan of the engine and then bends along the oil pan floor to reach the lowest point of the oil pan for almost complete removal of the spent oil, starting vacuum pump means to create vacuum within a spent oil container connected to the tube, thereby drawing spent oil from the oil pan of the engine into the environmentally safe spent oil container external of the engine. After the spent oil is removed from the oil pan of the engine, the tube is removed from the dipstick aperture in the engine and the dipstick is replaced. Oil can then be replenished in the engine by pouring the oil through the valve cover opening as is conventional. Once the appropriate amount of oil is added to the engine the oil fill cap is replaced on the valve cover.

In the alternative, the method can include the introduction of fresh oil through the tube disposed within the dipstick aperture in the engine, prior to removal of the tube and replacement of the dipstick. In the alternative, a fluid fill adaptor can be inserted in the valve cover opening of the engine in order to introduce fresh oil into the engine block. Yet another embodiment of the present invention provides for the introduction of fluid through the dipstick sleeve by means of an adaptor attached to the outermost end of the dipstick sleeve.

The apparatus of the present invention includes a flexible or partially flexible tube engageable through the dipstick sleeve attached to the engine block in fluid communication with the oil pan reservoir, pump means in communication with the tube for removing spent oil from the oil pan reservoir of the engine block, and spent oil receptacle means for storing spent oil external of the engine block. In the preferred embodiment of the present invention, the pump means includes vacuum means engageable with the spent oil receptacle means for creating a vacuum within the receptacle means thereby drawing oil into the receptacle means through the tube. The vacuum means can include a vacuum pump.

The apparatus of the present invention also includes a universal valve cover opening oil fill adaptor. The universal configuration of the valve cover opening fluid fill adaptor includes a connector conduit adapted to extend inwardly within the valve cover opening. A plug member having a pair of opposed parallel faces with a tapered outward surface is disposed on the connector conduit and adapted to sufficiently deform in response to compression forces on the opposed parallel faces to outwardly deflect the tapered outer surface into sealing contact with the valve cover opening. Means are provided for subjecting the plug member to compressive forces on the opposed parallel faces. A modified version of the valve cover opening fluid fill adaptor replaces the plug member and compressing means with a cap having an outwardly extending connector conduit. The cap is adapted to be threadingly received within the valve cover opening. A third fluid fill adaptor embodiment engages with the outermost end of the dipstick sleeve. The adaptor provides a connector conduit for the introduction of fluid into the engine through the dipstick sleeve.

Other modifications, characteristics, features and benefits of the present invention will become apparent upon reading the following detailed description of the invention in conjunction with the attached drawings.

BRIEF DESCRIPTION OF THE DRAWINGS

In the following drawings, like reference numerals refer to like parts throughout the various views, wherein.

DETAILED DESCRIPTION OF THE PREFERRED EMBODIMENT

Figure 1:
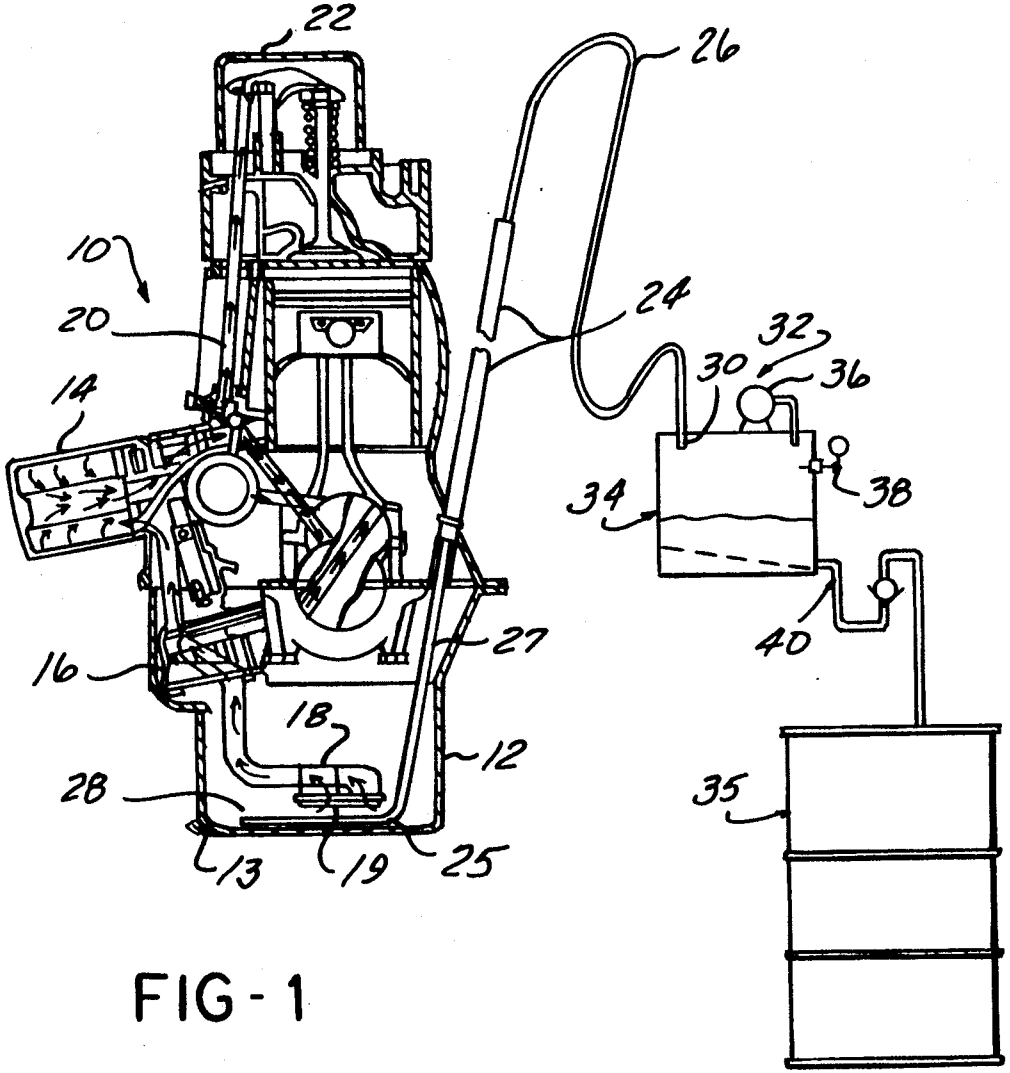
FIG. 1 is a schematic of an oil change apparatus according to the present invention.

Referring now to the drawings, and in particular to FIG. 1, there is shown a schematic cross sectional view of an engine labelled generally as 10. The engine 10 generally includes an oil pam reservoir 12 with a drain plug 13, an oil filter 14, an oil pump 16 drawing oil from the oil pan reservoir 12 through a suction inlet 18 having an inlet screen 19. The oil pump 16 being interconnected with the oil filter and other internal components of the engine through oil passages generally designated 20. The engine 10 also includes a valve cover 22 having an oil cap disposed thereon as is conventional for the introduction of oil into the engine 10. The engine 10 also includes a dipstick engageable through a dipstick sleeve 24 connected to the engine 10 as is conventional for measuring the level of oil within the oil pan reservoir 12.

The present invention provides a tube 26 engageable through the dipstick sleeve 24, such that one end 28 of the tube 26 can engage and extend along the bottom of the oil pan reservoir 12 to reach its lowermost portion. The other end 30 of the tube 26 is in communication with pump means 32 for drawing spent oil from the oil pan reservoir 12 externally of the engine 10. Receptacle means 34 and 35 are provided for storing spent oil external of the engine 10.

The tube 26 is constructed of a suitable bendable material or in a flexible manner to permit it to be inserted into the dipstick sleeve 24 and move threadingly along the bottom of the oil pan reservoir 12. The flexibility of the tube 24 permits the distal end 28 to remain in contact with the bottom of the oil pan reservoir 12 to seek its remote lowermost portion to effectively remove oil contained in such areas.

As shown in FIG. 1, the tube 26 can be composed of a lower, flexible portion 25 which is deflectable by and can conform to the inner surface of the lowermost potion of the oil pan reservoir 12 and a rigid upper portion 27 which generally conforms to the dipstick sleeve 24 when the apparatus of the present invention is inserted therein. When fully inserted, the flexible portion lays along the bottom of the oil pan reservoir 12 and terminates at or in the lowermost portion. The flexible portion 25 may be constructed of nylon, polyvinyl chloride and other plastic materials.

In a preferred embodiment of the present invention, the pump means 32 includes vacuum means, such as vacuum pump 36, for drawing vacuum within the receptacle means 34 sufficient to thereby draw spent oil up through the tube 26 for deposit in the receptacle means 34. Other embodiments of the pump means 32 may include a direct in line pump connected to the tube 26 having sufficient suction lift to draw spent oil from the oil reservoir 12 for discharge through the pump into the receptacle means 34. However, the vacuum pump 36 is preferred.

The receptacle means 34 can include level sensing means 38 for indicating when the level of spent oil within the receptacle means 34 reaches a predetermined level. The receptacle means 34 may also include a drainage passage 40 for removal of the spent oil from the receptacle means 34. It is anticipated that the receptacle means 34 would be sized to accommodate at least one complete spent oil removal volume as required for the particular engine being serviced. The receptacle means 34 can then be used for transporting the spent oil to a local collection and recycling center in an environmentally safe manner. The receptacle means 34 can also be made self-draining so that a batch may be emptied automatically into a larger container 35, such as a drum, for storage and transportation to a local collection and recycling center in an environmentally safe manner.

Figure 2:
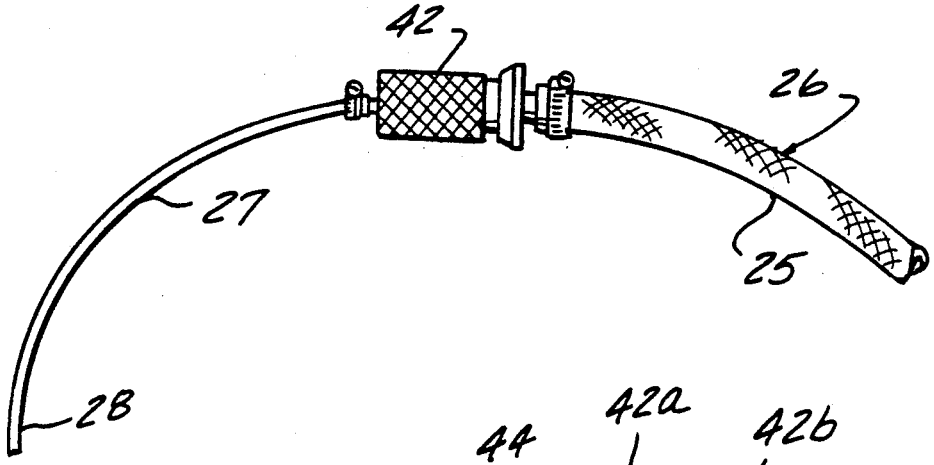
FIG. 2 is a detailed view of a tube insertable through a dipstick sleeve of an engine for removal of spent oil and/or introduction of fluid, such as fresh oil, into the oil pan of the engine.

A detailed view of the tube 26 can be seen in FIG. 2. This embodiment of the tube 26 would include a flexible hose 25 and a semi-rigid tube 27 with a diameter and length adapted to fit within the dipstick sleeve opening to extend down into the bottom of the oil pan 12. The flexible hose 25 and the semi-rigid tube 27 are interconnectable with one another by means of a quick disconnect fitting 42. Various types of quick disconnect fittings 42 are known in the hose art and are commercially available. The quick disconnect fitting 42 allows various flexible hoses 25 to be connected to the semi-rigid tube 27. For example, a first flexible hose 25 can be connected to the semi-rigid tube 27 for removal of the spent oil from the oil pan 12. Upon completing the removal of the spent oil from the oil pan 12, the first flexible hose 25 can be disconnected at the quick disconnect fitting 42, and a second flexible hose 25 can be connected for introducing fresh oil into the oil pan 12.

Figure 3:
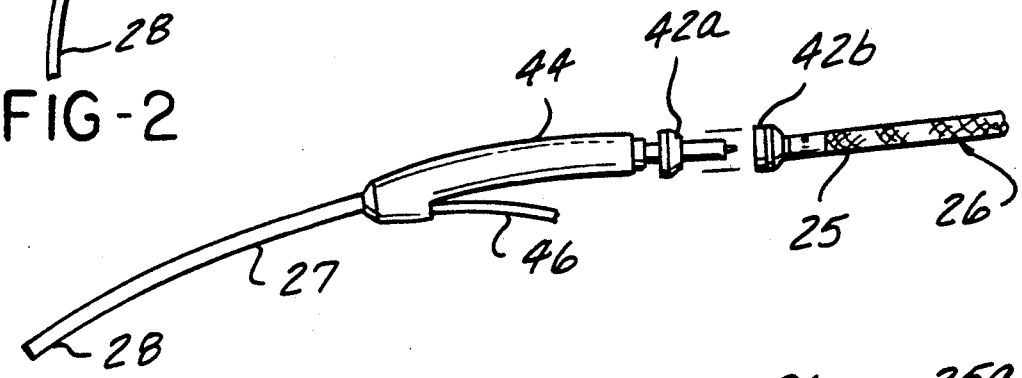
FIG. 3 is a modified version of the tube depicted in FIG. 2.

A modified version of the tube 26 is shown in FIG. 3. In this version, a rigid handle 44 is disposed between the semi-rigid tube 27 and the quick disconnect fitting 42. The quick disconnect fitting 42 comprises a first portion **42*a* which is connected to the rigid handle 44, and a second portion 42*b* which is connected to the flexible hose 25. The rigid handle 44 preferably includes a trigger valve mechanism and trigger handle 46, which in the normal closed position prevents communication between the semi-rigid tube 27 and the flexible hose 25. Actuation of the trigger handle 46 toward the rigid handle 44 causes the trigger valve mechanism to open thereby allowing communication between the semi-rigid tube 27 and the flexible hose 25. As previously described, the quick disconnect fitting 42 allows attachment of various flexible hoses 25 to the semi-rigid tube 27 and attached rigid handle 44. By way of example, a first suction hose 25 may be connected by means of the quick disconnect fitting 42 to the rigid handle 44 to draw spent oil from the oil pan 12. A fresh oil delivery hose 25 may be connected to the rigid handle 44** in order to introduce fresh oil directly into the oil pan of the engine.

Figure 4:
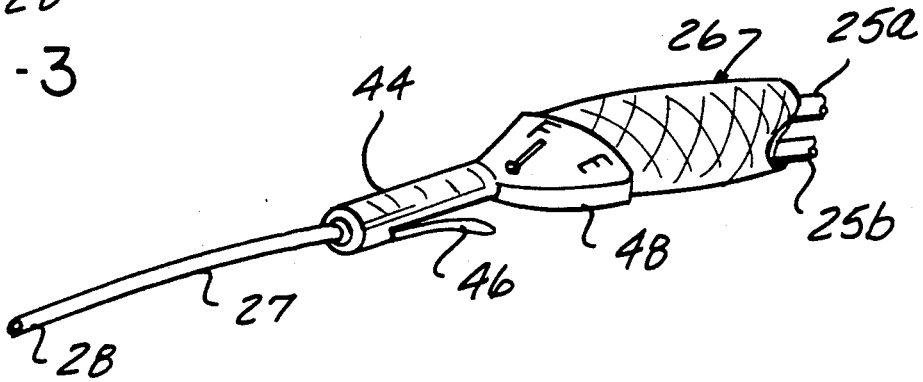
FIG. 4 is a further modified version of the tube depicted in FIG. 3.
Figure 5:
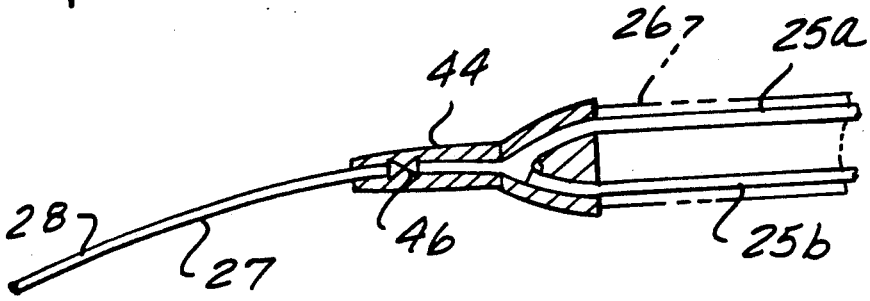
FIG. 5 is a cross-sectional schematic view of the tube depicted in FIG. 4.

Referring now to FIGS. 4 and 5, a third embodiment of the tube 26 is shown. In this embodiment, the quick disconnect fitting 42 is replaced with a multi-directional valve 48 capable of connecting the semi-rigid tube 27 with at least two flexible hoses **25*a* and 25*b*. The multi-directional valve 48 selectively communicates the tube 27 with a flexible suction hose 25*a* or a flexible fill hose 25*b***.

Figure 10:
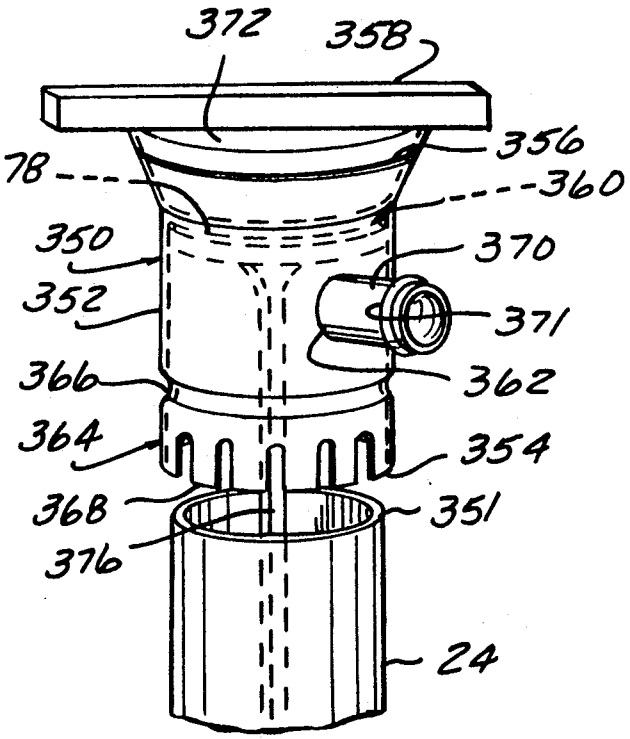
FIG. 10 is a perspective view of a fluid fill adaptor engageable with an outermost end of a dipstick sleeve of an engine.

Other aspects of the present invention provide an oil fill adapter which may be removably attached to either the oil fill opening in the engine valve cover 22 as shown in FIGS. 6, 7, 8 and 9 or to the dipstick sleeve 24 as shown in FIG. 10. The oil fill adapters generally include means for sealingly attaching the oil fill adapter to the respective engine opening, means for connecting a suitable filling hose to the adapter and a suitable passage for conveying fresh oil into the crankcase.

Figure 6:
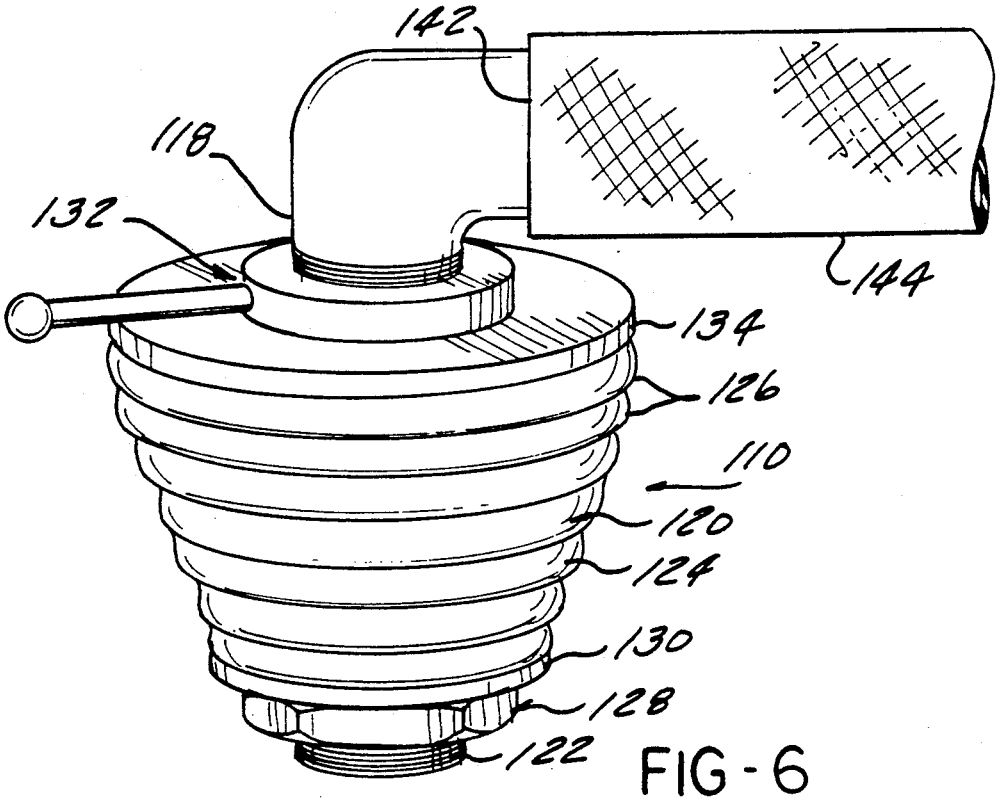
FIG. 6 is a perspective view of a universal valve cover opening fluid fill adaptor.
Figure 7:
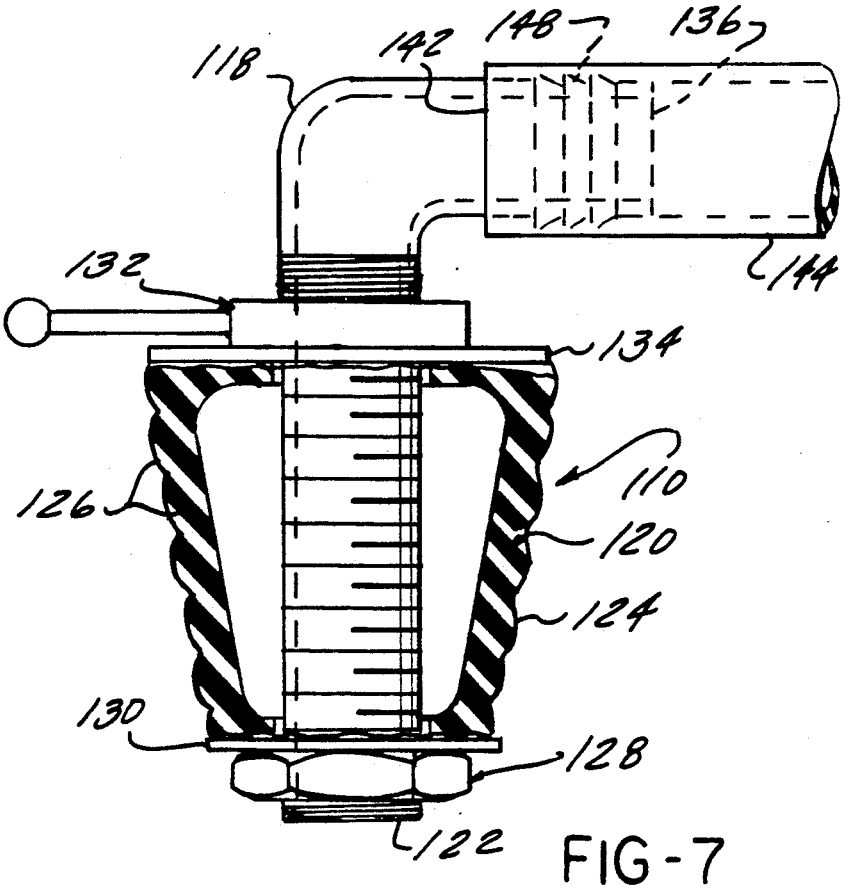
FIG. 7 is a cross-sectional view of the fluid fill adaptor depicted in FIG. 6.

The oil fill apparatus shown in FIGS. 6 and 7 is configured to work as a universal valve cover oil fill adaptor 110 which can be removably positioned in a variety of valve cover openings of differing diameters. This embodiment of the valve cover adapter typically does not function as an oil filler cap replacement rather, when oil change or replenishment is desired, the conventional oil filler cap (not shown) can be removed and the universal valve cover oil fill adapter 110 inserted into the opening.

The oil fill adapter 110 of the present invention includes a connector 118 which is preferably an angular hollow conduit. The connector 118 has a first end 122 adapted to extend inwardly in the valve cover opening. The connector 118 is movably connected with a plug member 120 having a central aperture through which the connector 118 extends.

The plug member 120 includes a sealing member which can be placed in sealing contact with the valve cover opening. The plug member 120, preferably, has a pair of opposed parallel faces through which connector 118 perpendicularly extends. Between the opposed faces is a tapered outer surface region 124 which, preferably has a series of contours such as ridges 126 which aid in establishing sealing contact between the plug member 120 and the surfaces surrounding the valve cover opening. The plug member 120 has a hollow interior central cavity defined by the interior of the opposed faces and interior of the tapered outer surface region 124. The plug member 120 is constructed from a material having sufficient deformability that compression of the opposing faces of the plug member 120 will result in an outward deflection of the surface of the tapered region 124.

The plug member 120 is held in position relative to the connector 118 by a suitable retaining means 128 located on the connector 118 adjacent to the first end 122. The retaining means 128 may be a suitable nut or annularly extending flange connected to the connector 118.

The plug member 120 is oriented such that the smaller opposing face is positioned in close proximity or abutting relationship with retaining means 128. As shown in FIG. 7, a first washer 130 is interposed between the retaining means 128 and the smaller opposing face.

A releasable tightening means 132 is connected to the connector 118 to compress the plug member 120 and expand tapered sides 124. The tightening means 132 can be a suitably machined round nut with a locking lever. Interposed between the tightening means 132 and the larger opposed face of the plug member 120 is a second washer 134.

The second end 136 of connector 118 (shown in phantom in FIG. 7) is insertable within the terminal end 142 of fill hose 144. The fill hose 144 and connector 118 are connected by a suitable leak-tight clamping means such as a self-locking hose adaptor and corresponding self-locking hose as are commercially available.

Figure 8:
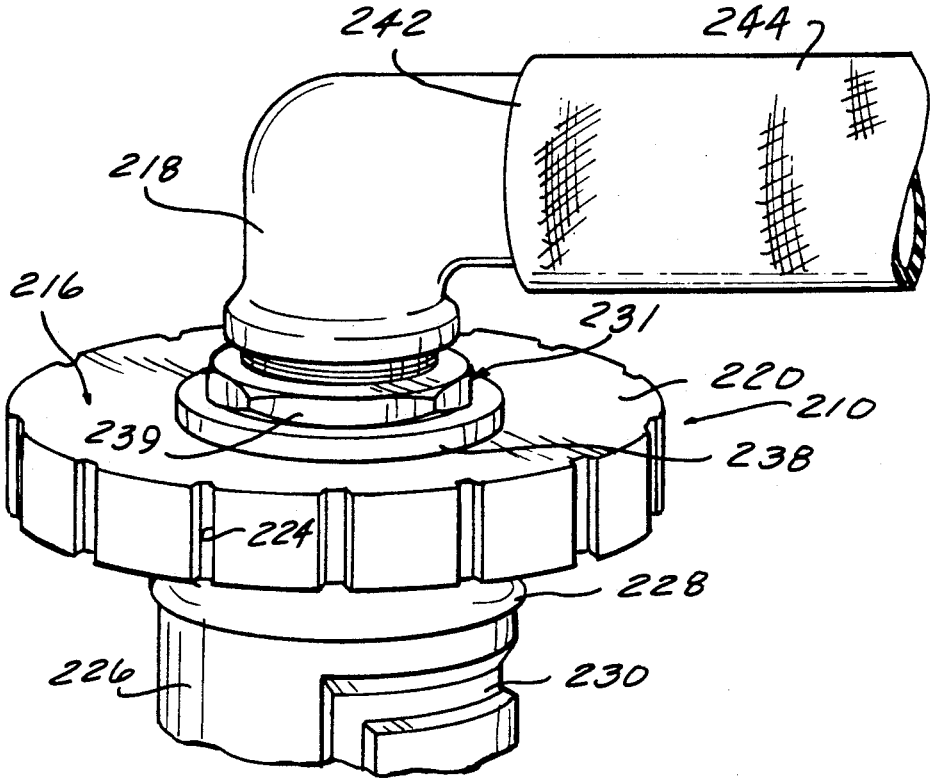
FIG. 8 is a perspective view of a modified fluid fill adaptor.
Figure 9:
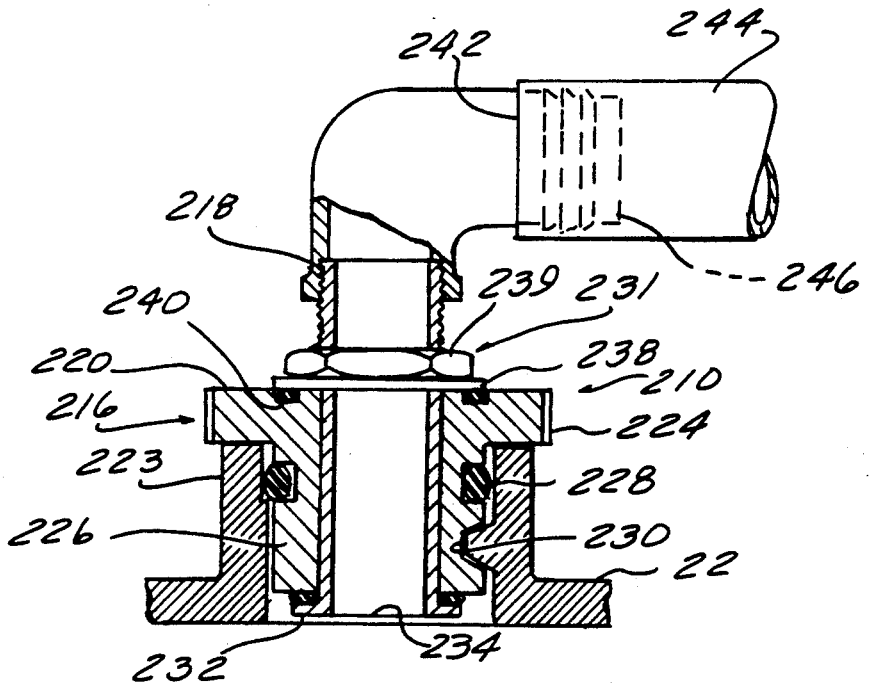
FIG. 9 is a cross-sectional view of the modified fluid fill adaptor depicted in FIG. 8.

In another embodiment as shown in FIGS. 8 and 9, the oil fill adapter 210 of the present invention is adapted to be threadingly inserted in the oil fill opening in the engine valve cover. This oil fill adaptor may be used to replace the conventional oil fill opening cover. The oil fill adapter 210 of this embodiment is composed of an oil filler cap portion 216 and a connector 218.

The oil filler cap portion 216 includes an overlying lid 220 with optional exterior laterally oriented gripping ridges 224. The lid 220 has a diameter larger than that of the oil fill opening in the engine valve cover and is adapted to overly an upwardly extending lip 223 located on the engine valve cover 22. The cap portion 216 of the oil fill adapter 210 also includes an insert sleeve 226 adapted to be matingly insertable within the valve cover opening, or the upwardly extending lip 223 if present in the particular engine design. The insert sleeve 226 preferably includes a sealing means 228. The sealing means 228 is, preferably, an O-ring. The sleeve 226 also has a suitable fastening means 230 to maintain the oil fill adapter 210 in position in the associated valve cover opening. The fastening means 230 is preferably a threaded surface adapted to matingly connect with a mating surface on the interior of the lip 223 of the oil fill opening in the engine valve cover 22.

The connector 218 is attached to the screw lid 220. The connector 218, preferably, includes means for attaching the connector to the screw lid 220. In the preferred version of this embodiment, the connector 218 is free to rotate relative to the lid 220 by means of a leak-tight swivel connection means 231. One such example of a suitable swivel means 231 is shown in FIGS. 8 and 9. This swivel means 231 includes an annular flange member 232 attached to a first end 234 of connector 218 located on the connector 218 at a position where the connector 218 extends through a suitable aperture centrally located in lid 220 into the interior space defined by the lid 220 and the insert sleeve 226.

In the embodiment shown in FIG. 9, a second exterior annular washer 238 is attached to the connector 218 at a central position between nut 239 and lid 220 which, in combination with the interior annular flange 232, holds the connector in fixed lateral position relative to the lid 220. Interpositioned between the lid 220 and the exterior annular washer 238, is a sealing gasket 240.

The connector 218 as shown in FIGS. 8 and 9 is an angular conduit having a first end 234 located in the interior space defined by the lid 220 and insert sleeve 226 as described previously. The first end 242 of a suitable fill hose 244 is attached to the second end 246 of the connector 218 by a self locking hose adaptor provided on the connector 118 to attach to a section of self locking hose as is conventional to eliminate the need for a hose clamp.

A dipstick sleeve adapter 350 is depicted in FIG. 10. The dipstick sleeve adapter 350 can be attached to the dipstick sleeve 24 of the engine 10 to provide means for introducing fresh oil. In current configurations of engines 10, the dipstick sleeve 24 cannot be used for evacuation of spent oil, because the dipstick sleeve 24 does not extend adjacent to the lowermost bottom portion of the oil pan. However, if future engine design incorporates a dipstick sleeve 24 extending within the engine to a position adjacent the lowermost portion of the bottom of the oil pan 12, it is envisioned that this configuration of the present invention can be incorporated into the dipstick sleeve as a permanent fixture for evacuation of spent oil and introduction of fresh oil, or in the alternative may continue to be offered as an adapter which may be placed on the outermost end of the dipstick sleeve 24 for evacuation of spent oil and/or introduction of fresh oil, respectively.

The oil fill adapter 350 of the present invention is adapted to be attached to the dipstick sleeve 24 of the associated engine. The oil fill adapter 350 has a central body 352 having a first outlet 354 adapted to fit matingly with the terminal end of dipstick sleeve 24 and a second opposed outlet 356 adapted to receive the engine dipstick 358 and a suitable dipstick sealing means 360. The central body 352 also has a centrally located hose connection inlet point 362.

The first outlet 354 of the central body 352 is equipped with an attaching means 364 and a retention collar 366. When attached to the dipstick sleeve 24, the terminal end 351 of the dipstick sleeve 24 abuts the inner surface of retention collar 366. The attaching means 364 is preferably a series of fluted extensions 368 extending outward and downward from the retention collar 366, which are adapted to overlie the area of the dipstick sleeve 24 adjacent to the terminal end 351. In the preferred embodiment, the attaching means 364 also includes a suitable clamp (not shown) adapted to encircle the fluted extensions 368 to clampingly contact them in position against the outer surface of the dipstick sleeve 24.

The retention collar 366 is, preferably, an interiorly projecting annular ring interposed between the sealing means 360 and the centrally located hose connection point 362. In order to facilitate a sealing connection between the terminal end 351 of dipstick sleeve 24 and the oil fill adapter 350, the retention collar 366 can include a suitable gasket or compressible member (not shown).

The centrally located hose connection inlet point 362 is, preferably, a hollow member 370 projecting angularly outward from the central body 352. A suitable fill hose (not shown) is attached to the hollow member 370 by any suitable attachment means. In FIG. 10, the angularly projecting hollow member has an annular flange 371 positioned on its outer surface. The terminal end of an appropriate fill hose can overlay the flange 371 and be maintained in position by an appropriate fastening means (not shown).

The hollow member 370 has a central hollow passage in fluid communication with a hollow central interior passage defined by the central body 352 of oil fill adapter 350. The hollow member 370 may project outwardly from the central body 352 at any desired angular orientation. In the embodiment shown in FIG. 10, the hollow member 370 extends perpendicularly from the central body 352 relative to its longitudinal axis. The diameter of the central interior passage defined by the central body 352 is essentially equal to that defined by the interior of the dipstick sleeve 24.

A plug 372 is sealingly positioned in the second outlet 356 to prevent egress of fluid introduced through the centrally located hose connection point 362. In the preferred embodiment, the plug 372 is manually removable from the second outlet 356. When a vehicle operator wishes to check the engine oil level in his or her vehicle, the dipstick 358 can be removed with dipstick plug 372. The length of the indicator blade of the dipstick 358 is then wiped clean, as is conventional, and the entire combination of dipstick 358 and plug 372 is, then inserted into the apparatus 350 and retracted; giving a visual indication of engine oil level. In order to give an accurate oil level indication, it is to be understood that the indicator blade 376 of the dipstick 358 may be elongated to include the added height of the oil fill apparatus 350 of the present invention or the external terminal end 351 of the dipstick sleeve 24 may be appropriately shortened prior to installation of the adaptor 350.

In order to provide a sufficient sealing fit between the plug 372 and the central body 352 of the present invention, the sealing means 360 may include suitable sealing members incorporated in the central body 352 such as a sealing ring 78 angularly disposed in the interior of the central body 352.

In all embodiments, the fill hose 144, 244 connected to the connector 118, 218 or hose connection point 362 may be equipped with a suitable quick connect coupling **42*a* or 42*b* (shown in FIG. 2–5) adapted to be matingly received in a suitable coupling 42*b* or 42*a*, respectively, on the appropriate oil fill hose 26. It is also within the purview of the invention, to have fill hose 244 permanently connected to the oil fill adapter 110** and extending to a conveniently located quick coupling bracket mounted within the engine compartment.

Where both a valve cover opening oil fill adapter 110 or 210 and a dipstick sleeve oil fill adapter 350 are employed on the same vehicle, these devices may be employed in tandem to decrease the total time necessary to accomplish oil filling.

When employing an oil fill adapter such as those of the present invention to facilitate an oil change procedure, spent oil may be removed from the vehicular oil pan by conventional means if necessary. However, it is within the purview of this invention to facilitate and speed the removal of spent oil by utilizing a specially equipped tube 26, as previously described.

In an oil change process according to the present invention, the dipstick would be removed from the dipstick sleeve of an engine. A tube 26 would be inserted within the dipstick sleeve 24 so that an end 28 of the tube 26 extends flexibly down to the lowermost portion of the oil pan 12 of the engine 10. Suction pressure is then applied through the tube 26 to draw the spent oil up through the tube for deposit into an external container. On completion of the removal of all of the spent oil, or a substantial portion thereof, the suction, or vacuum pressure, is removed from the tube 26. The spent oil in the external container can then be recycled or disposed of in an environmentally sound manner. An appropriate amount of fresh motor oil can be introduced into the engine through the tube 26 prior to the removal of tube 26 if desired. After the fresh oil has been added, the tube 26 can be removed from the dipstick sleeve 24. The dipstick is then reinserted within the dipstick sleeve 24 and the engine operated in the normal manner.

As an alternative to introducing fluid into the engine through the tube 26, the present invention also provides for introducing fluid into the engine through preexisting engine openings by the use of fluid fill adaptors. Therefore, the fluid introduced in the method described above can be introduced through any of these adaptors. Fresh oil can be introduced through the valve cover opening fluid fill adaptors previously described. The introduction of fresh motor oil can be accomplished independently through the valve cover opening fluid fill adaptor by itself, or in combination with fresh motor oil being introduced through the tube 26 simultaneously. Of course, in order to introduce fluid through the dipstick sleeve opening adaptor, the tube 26 must first be removed and the dipstick and plug must be reinserted prior to introducing fluid through the connector conduit of the dipstick sleeve fluid inlet adaptor. If desired or required, the oil filter 14 may be changed during the oil change process. This can occur at any time, but would preferably occur after the removal of the spent oil from the oil pan 12.

The present invention provides a cleaner environment by providing a simplified, high-speed oil change process in which greater amounts of residual spent oil and contaminants can be removed in a manner which reduces the time necessary to accomplish an oil change. The present invention provides a cleaner crankcase environment for the fresh motor oil, and thereby improves motor filter life and engine performance.

While several embodiments of the invention have been disclosed in detail, it should be apparent to those skilled in the art that certain adaptations and modifications can be made to the present invention without departing from the scope of the invention, and therefore, the illustrations made in this description are to be considered as being by way of non limiting example. The true scope of the present invention is that as set forth in the appended claims.

What is claimed is:

1. An apparatus for changing oil in an internal combustion engine having a lubrication system including an oil pan reservoir, the oil pan reservoir having a lowermost region generally near a drain opening, a dipstick for gauging an oil level within the oil pan reservoir passing through a dipstick aperture within the engine, and a valve cover generally disposed on the engine having an oil filler opening extending therethrough, the apparatus for changing oil comprising:

a spent oil removal device removably insertable in the dipstick aperture and a fresh oil introduction device removably connectable to the engine at a position remote from the dipstick aperture, said spent oil removal device comprising:

a) a tube engageable through the dipstick aperture having a first end positionable adjacent to the lowermost region of the oil pan reservoir and a second end external of the engine;

b) pump means in communication with said second end of said tube for drawing spent oil from the oil pan reservoir of the engine; and c) receptacle means external of the engine for receiving and storing spent oil drawn from the oil pan reservoir of the engine through said tube; and said fresh oil introduction device comprising:

a) a coupling member removably engageable with the oil filler opening in the valve cover;

b) a fresh oil conveying conduit having a first and second end, said first end attached to said coupling member;

c) means for conveying fresh oil to the engine, said means being in fluid communication with said second end of said fresh oil conveying conduit;

wherein said coupling member further comprises:

a) a plug having first and second opposed walls with a tapered, deflectable side wall extending therebetween;

b) a connector conduit passing through the first and second opposed walls of the plug, said connector conduit having a first end disposable within the valve cover and a second end external of the valve cover and engine connected to said fresh oil conveying conduit; and c) means for compressing said first and second walls to deflect said tapered side wall into sealing engagement with said valve cover opening.

2. The coupling member of claim 1 wherein said compressing means comprises:

said connector conduit having external threads formed thereon and an enlarged annular portion on said first end engaging said first wall of said plug; and a lever having a threaded aperture engageable with the external threads formed on the connector conduit and engageable with the second wall of said plug, said lever operable to threadingly compress said plug by moving said second wall toward said first wall.

* * * * *